US011098549B2

(12) United States Patent
von Gynz-Rekowski et al.

(10) Patent No.: US 11,098,549 B2
(45) Date of Patent: Aug. 24, 2021

(54) MECHANICALLY LOCKING HYDRAULIC JAR AND METHOD

(71) Applicant: Workover Solutions, Inc., Imperial, PA (US)

(72) Inventors: Gunther H H von Gynz-Rekowski, Montgomery, TX (US); Mark Joshua Miller, Valencia, PA (US); Kevin James Rudy, Houston, TX (US); Russell Wayne Koenig, Conroe, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

(21) Appl. No.: 16/731,239

(22) Filed: Dec. 31, 2019

(65) Prior Publication Data

US 2021/0198966 A1 Jul. 1, 2021

(51) Int. Cl.
*E21B 31/113* (2006.01)
*E21B 33/12* (2006.01)

(52) U.S. Cl.
CPC ..... *E21B 31/113* (2013.01); *E21B 33/12* (2013.01)

(58) Field of Classification Search
CPC ..... E21B 31/113; E21B 33/12; E21B 17/07; E21B 31/107; E21B 31/1135
USPC ..... 166/178
See application file for complete search history.

(56) References Cited

U.S. PATENT DOCUMENTS 3,388,755 A * 6/1968 Webb ..... E21B 17/07 175/297
3,804,185 A 4/1974 Mason
4,865,125 A 9/1989 De Cuir
5,411,107 A 5/1995 Hailey et al.
5,647,446 A * 7/1997 Wenzel ..... E21B 31/113 166/178
6,003,607 A * 12/1999 Hagen ..... E21B 17/07 166/120
6,202,767 B1 * 3/2001 Friis ..... E21B 31/1135 166/178
6,290,004 B1 9/2001 Evans
6,655,460 B2 * 12/2003 Bailey ..... E21B 7/06 166/301
7,347,287 B2 * 3/2008 Chancey ..... E21B 31/1135 166/178

(Continued)

OTHER PUBLICATIONS

International Search Report and Written Opinion dated Jan. 27, 2021, from Applicant's counterpart International Patent Application No. PCT/US2020/057049.

*Primary Examiner* — Michael R Wills, III
(74) *Attorney, Agent, or Firm* — Jones Walker LLP

(57) ABSTRACT

A mechanically locking hydraulic jar device includes an outer sleeve, an inner sleeve partially disposed in an inner bore of the outer sleeve, and a mechanical lock engaging the outer sleeve and the inner sleeve in a default position to axially secure the inner sleeve to the outer sleeve. Activation of the hydraulic jar disables the mechanical lock to allow axial movement of the inner sleeve relative to the outer sleeve, which generates an impact force when the inner sleeve reaches an activated position. The hydraulic jar device also includes an upward block and a downward block configured to limit the upward and downward axial movement, respectively, of the inner sleeve relative to the outer sleeve when the mechanical lock is disabled.

20 Claims, 15 Drawing Sheets

(56) References Cited

U.S. PATENT DOCUMENTS

| | | | | |
|---|---|---|---|---|
| 8,205,690 | B2 * | 6/2012 | Evans | E21B 31/1135 175/297 |
| 8,230,912 | B1 * | 7/2012 | Connell | E21B 31/113 166/178 |
| 8,365,818 | B2 * | 2/2013 | Schultz | E21B 31/1135 166/178 |
| 8,657,007 | B1 * | 2/2014 | Watson | E21B 19/22 166/301 |
| 2005/0000735 | A1 | 1/2005 | Darnell | |
| 2007/0074867 | A1 * | 4/2007 | Chancey | E21B 31/1135 166/178 |
| 2010/0206568 | A1 * | 8/2010 | Dowling | E21B 31/107 166/301 |
| 2015/0027780 | A1 * | 1/2015 | Hern | E21B 37/02 175/57 |

* cited by examiner

MECHANICALLY LOCKING HYDRAULIC JAR AND METHOD

BACKGROUND

This present disclosure relates to a hydraulic jar device having a mechanical lock.

SUMMARY

The hydraulic jar device of the present disclosure may comprise: an outer sleeve including an inner bore; an inner sleeve partially disposed within the inner bore of the outer sleeve, wherein the inner sleeve includes an inner bore; a mechanical lock engaging the outer sleeve and the inner sleeve in a default position to prevent axial movement of the inner sleeve relative to the outer sleeve, wherein disabling the mechanical lock allows axial movement between the inner sleeve and the outer sleeve to generate an impact force when the inner sleeve reaches an activated position; an upward block configured to limit the upward axial movement of the inner sleeve relative to the outer sleeve when the mechanical lock is disabled; and a downward block configured to limit the downward axial movement of the inner sleeve relative to the outer sleeve when the mechanical lock is disabled.

DETAILED DESCRIPTION OF THE PREFERRED EMBODIMENTS

Figure 1:
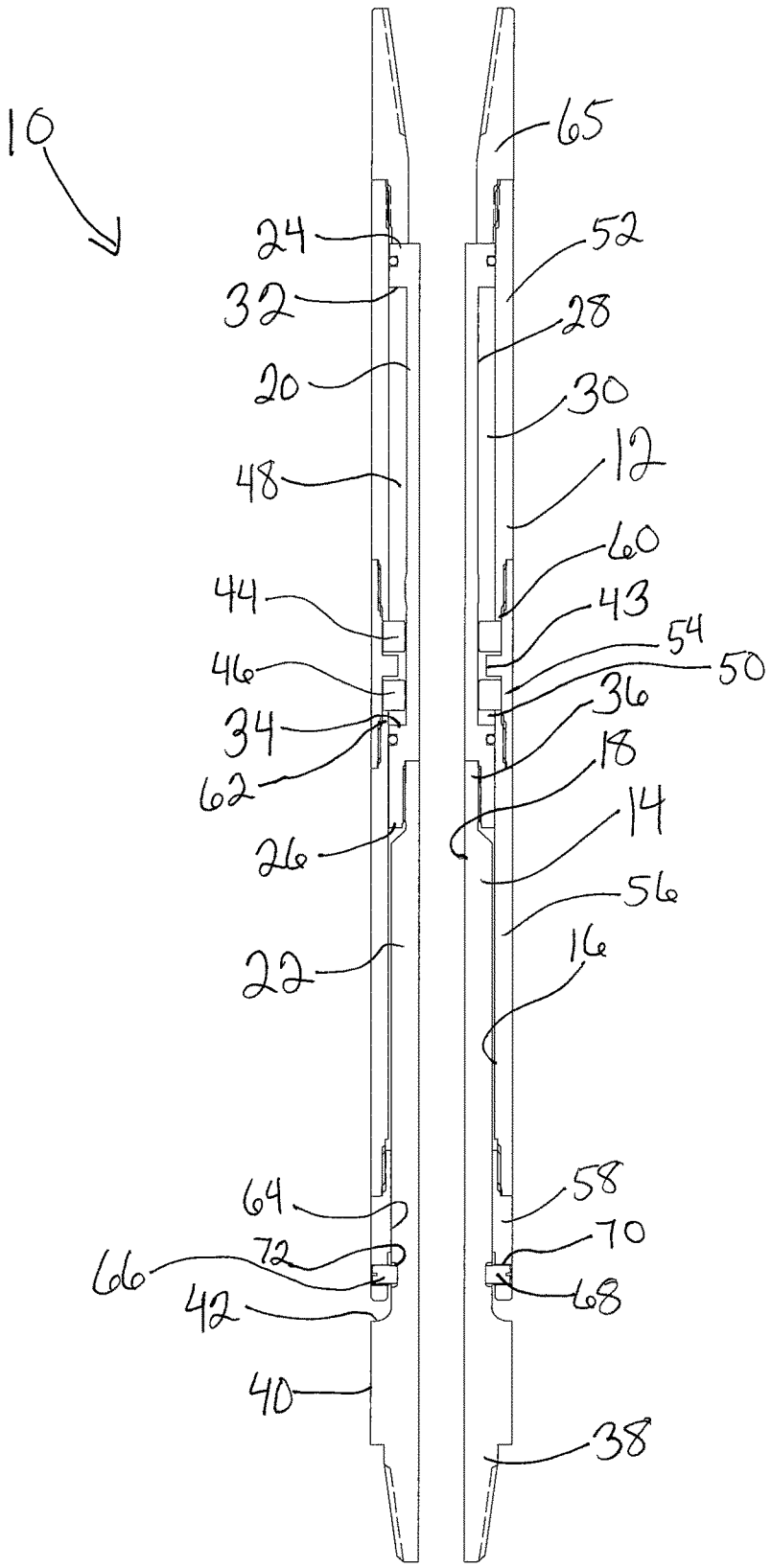
FIG. 1 is a sectional view of a mechanically locking hydraulic jar in a default position.

Conventional jar devices are placed in a tubular string above a bottom hole assembly, which typically includes a measurement while drilling sub, a drilling motor, and a drill bit. If the drill bit becomes stuck in the bottom of the wellbore, the conventional jar devices are activated to provide an upward impact load to assist in freeing the drill bit from the bottom of the wellbore. If the whole bottom hole assembly (BHA) becomes stuck in the bore (e.g., due to differential sticking), the conventional jar devices are activated to provide an upward and a downward impact load to assist in freeing the BHA. Conventional jar devices may also be secured to a coiled tubing string configured for well intervention operations. For example, the conventional jar devices may be secured below the coiled tubing string and above a bottom hole assembly. These conventional jar devices are often used in combination with other tools that generate pressure pulses. The pressure pulses of the other tools can cause an unintentional activation of the conventional jar devices. Pressure pulses of the other tools are generated by valve mechanisms chocking off the mudflow in a pulsating manner. A fluctuating mudflow will cause pressure pulses inside the conventional jar due to reduced flow passages throughout the conventional jar, which are acting as nozzles. These pressure pulses in the conventional jar generate fluctuating axial forces that push and/or pull on the conventional jar components, which activate the conventional jar.

A mechanically locking hydraulic jar device is configured to impart an impact force on other components secured directly or indirectly to the hydraulic jar device, such as a drill bit that has been immobilized or stuck within a wellbore. The hydraulic jar device includes a mechanical lock that prevents the hydraulic jar device from being unintentionally activated. The hydraulic jar includes an outer sleeve and an inner sleeve partially disposed within an inner bore of the outer sleeve. In a default position, the mechanical lock engages the outer sleeve and the inner sleeve to prevent axial movement of the inner sleeve relative to the outer sleeve. The mechanical lock maintains the hydraulic jar in the default position until a user intentionally activates the hydraulic jar to disable the mechanical lock, thereby allowing axial movement between the inner sleeve and the outer sleeve. For example, the inner sleeve may axially slide relative to the outer sleeve to place the hydraulic jar in an activated position. The hydraulic jar may also include an upward block and a downward block configured to limit the upward and downward axial movement, respectively, of the inner sleeve relative to the outer sleeve when the mechanical lock has been disabled. The hydraulic jar may be activated by applying an upward force on the outer sleeve or a downward force on the inner sleeve. Alternatively, the hydraulic jar may include a ball seat on the inner sleeve, and the hydraulic jar may be activated by engaging the ball seat with a ball that is pumped through the hydraulic jar. The ball can be made of dissolvable material, such as magnesium, a dissolvable rubber, or a dissolvable polymer. The ball fluidly seals an inner bore of the inner sleeve such that continued pumping of fluid applies a downward force on the inner sleeve.

With reference to FIG. 1, mechanically locking hydraulic jar 10 may include outer sleeve 12 and inner sleeve 14 partially disposed within inner bore 16 of outer sleeve 12. In the embodiment illustrated, a lower end of inner sleeve 14 extends beyond a lower end of outer sleeve 12. Inner sleeve 14 includes an inner bore 18.

Referring again to FIG. 1, inner sleeve 14 includes upper inner sleeve segment 20 and lower inner sleeve segment 22. Upper inner sleeve segment 20 is completely disposed within inner bore 16 of outer sleeve 12, while lower inner sleeve segment 22 is partially disposed within inner bore 16 of outer sleeve 12. Upper inner sleeve segment 20 extends from upper end 24 of inner sleeve 14 to lower end 26 of upper inner sleeve segment 20. The outer surface of upper inner sleeve segment 20 includes recess 28 forming cavity 30 between outer sleeve 12 and inner sleeve 14. Cavity 30 may extend from upper cavity shoulder 32 to lower cavity shoulder 34 of the outer surface of upper inner sleeve segment 20. Lower inner sleeve segment 22 extends from upper end 36 secured to lower end 26 of upper inner sleeve segment 20 to lower end 38 of inner sleeve 14. The outer surface of lower inner sleeve segment 22 includes expanded diameter section 40 disposed below the lower end of outer sleeve 12. Expanded diameter section 40 forms upward facing shoulder 42. Upper and lower inner sleeve segments 20, 22 may be secured together by threaded connection.

With reference still to FIG. 1, outer sleeve 12 includes inward protrusion 43 extending radially inward from the surface of inner bore 16 of outer sleeve 12. Inward protrusion 43 is formed by a reduced diameter section of the inner surface of inner bore 16 of outer sleeve 12. Inward protrusion 43 is axially aligned with cavity 30. In other words, inward protrusion 43 extends into cavity 30. Throttling rings 44 and 46 are disposed in cavity 30, with throttling ring 44 above inward protrusion 43 and throttling ring 46 below inward protrusion 43. Upper cavity 48 is formed between upper cavity shoulder 32 and throttling ring 44, and lower cavity 50 is formed between throttling ring 46 and lower cavity shoulder 34. In the default position as shown in FIG. 1, upper cavity 48 is larger than lower cavity 50. A hydraulic fluid may be disposed within cavity 30. Throttling ring 44 is configured to restrict the flow of hydraulic fluid from upper cavity 48 to lower cavity 50 when hydraulic jar 10 is under tension. When the hydraulic fluid flows past throttling ring 44 and into lower cavity 50, hydraulic jar 10 generates a downward impact. Throttling ring 46 is configured to restrict the flow of hydraulic fluid from lower cavity 50 to upper cavity 48 when hydraulic jar 10 is under compression in an activated position (described in more detail below). When hydraulic fluid flows past throttling ring 46 and into upper cavity 48, hydraulic jar 10 generates an upward impact.

Outer sleeve 12 may also include first outer sleeve segment 52, anchor outer sleeve segment 54 disposed below first outer sleeve segment 52, second outer sleeve segment 56 disposed below anchor outer sleeve segment 54, and lower outer sleeve segment 58 disposed below second outer sleeve segment 56. Inward protrusion 43 may be disposed on anchor outer sleeve segment 54. Throttling ring 44 may be secured between lower end 60 of first outer sleeve segment 52 and inward protrusion 43. Throttling ring 46 may be secured between inward protrusion 43 and upper end 62 of second outer sleeve segment 56. Inner bore 64 of lower outer sleeve segment 58 has a diameter that is smaller than the diameter of the inner bores of first and second outer sleeve segments 52, 56. Hydraulic jar 10 may further include top sub 65 connected above first outer sleeve segment 52. Top sub 65 is configured to attach hydraulic jar 10 below a tubular member or a coiled tubing string. Segments 52, 54, 56, 58 and top sub 65 may be secured together by threaded connection. The lower end of inner sleeve 14 is configured to attach one or more components below hydraulic jar 10, such as a measurement while drilling sub, a drilling motor, and/or a drill bit.

Figure 2:
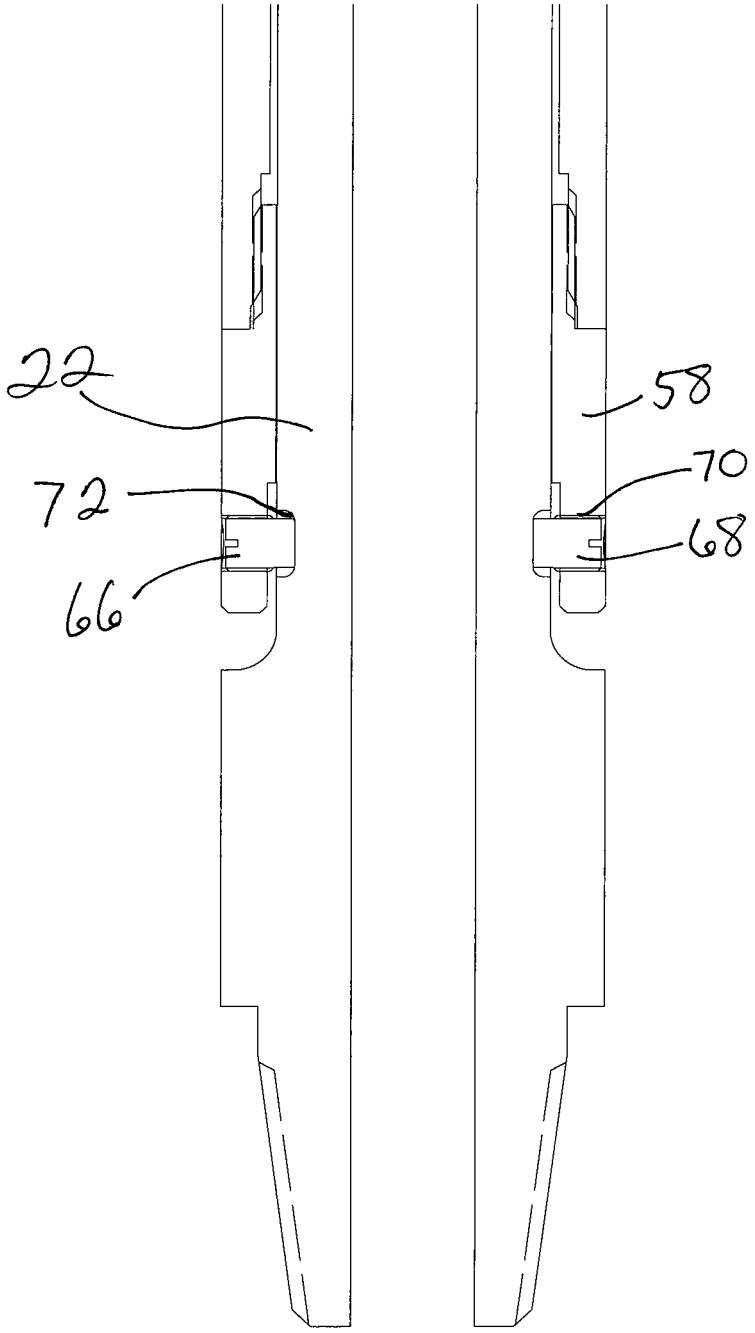
FIG. 2 is a partial sectional view showing the mechanical lock with the hydraulic jar in the default position.

Referring now to FIGS. 1 and 2, hydraulic jar 10 includes a mechanical lock that prevents the hydraulic jar device from being unintentionally activated. In the embodiment illustrated in FIG. 1, the mechanical lock includes shear pins 66, 68. The mechanical lock may include any number of shear pins, such as 1-10 shear pins. Lower outer sleeve segment 58 includes one or more radial bores 70. The outer surface of lower inner sleeve segment 22 includes one or more recesses 72. In the default position shown in FIG. 1, each recess 72 is aligned with one of the radial bores 70 and each of shear pins 66, 68 are partially disposed within a radial bore 70 in outer sleeve 12 and partially disposed within a recess 72 in inner sleeve 14. In this way, shear pins 66, 68 engage inner and outer sleeves 12, 14 in the default position to prevent axial movement between outer and inner sleeves 12, 14.

Hydraulic jar 10 may be activated by applying a downward force on inner sleeve 14 or by applying a downward or an upward force on top sub 65 and outer sleeve 12. When the downward or upward force exceeds a threshold, the mechanical lock is disabled to allow relative axial movement between inner sleeve 14 and outer sleeve 12. The movement of inner sleeve 14 relative to outer sleeve 14 generates an impact force, which is transmitted to the components attached to hydraulic jar 10.

Figure 3:
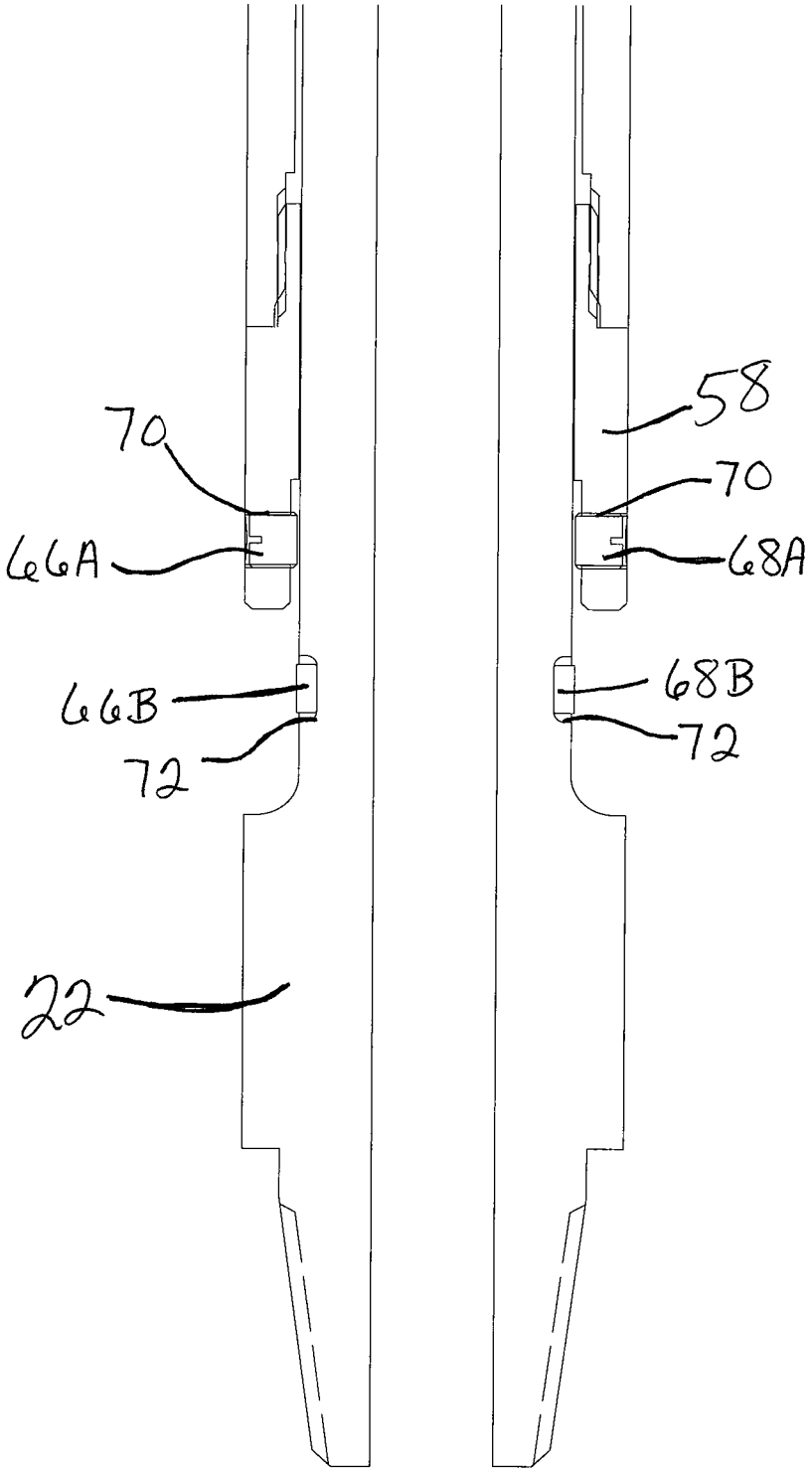
FIG. 3 is a partial sectional view showing the mechanical lock with the hydraulic jar in an activated position.

With reference to FIG. 3, activation of hydraulic jar 10 may cause shear pins 66, 68 to be severed into segments 66A, 68A held in radial bores 70 of lower outer sleeve segment 58 and segments 66B, 68B held in recesses 72 of lower inner sleeve segment 22, respectively. The severing of shear pins 66, 68 allows inner sleeve 14 to move axially relative to outer sleeve 12.

Figure 4:
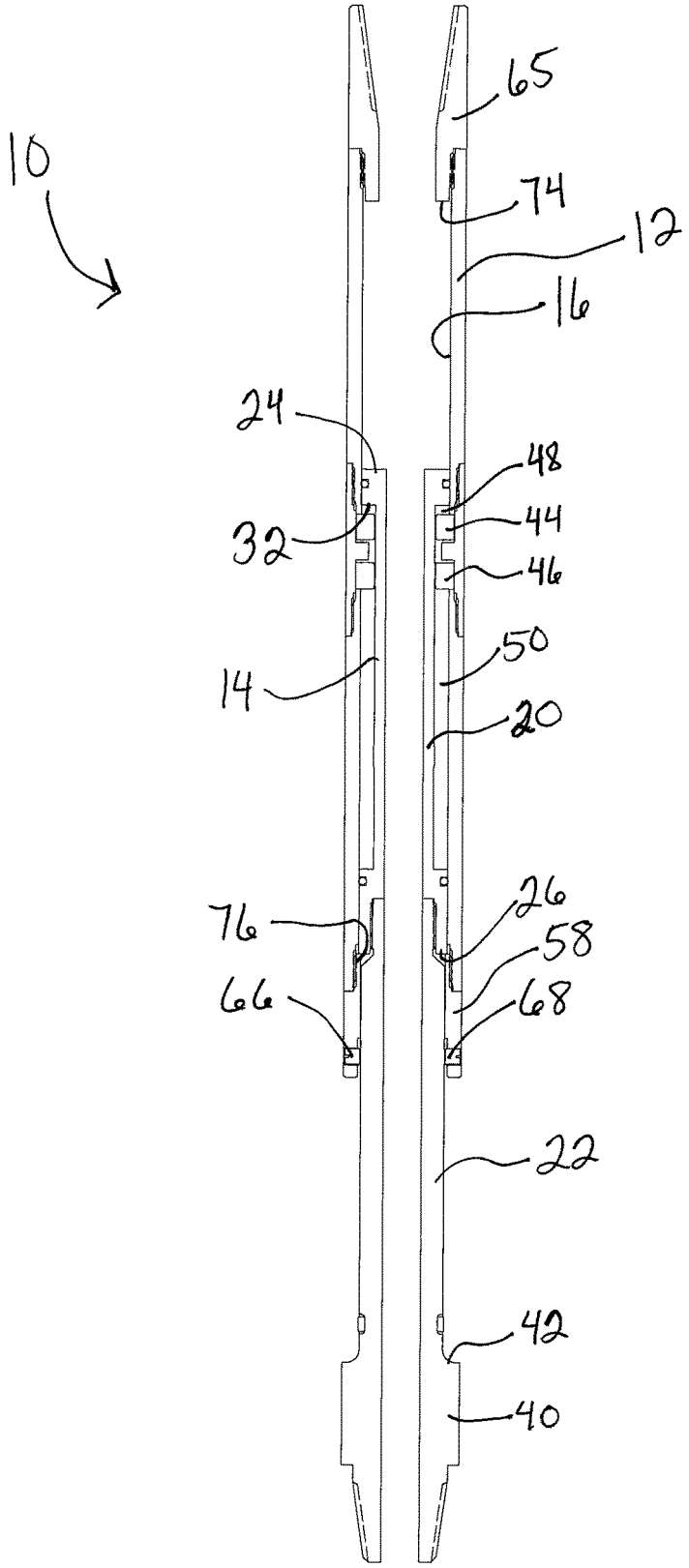
FIG. 4 is a sectional view of the hydraulic jar in the activated position.

Referring now to FIG. 4, the downward and upward axial movement of inner sleeve 14 (in the orientation shown) relative to outer sleeve 12 is limited by a downward block and an upward block, respectively, when the mechanical lock is disabled. The upward block may be formed by lower end 74 of top sub 65, which is disposed within inner bore 16 of outer sleeve 12. Lower end 74 of top sub 65 is configured to engage upper end 24 of inner sleeve 14 to limit the upward movement of inner sleeve 14. In the default position shown in FIG. 1, upper end 24 of inner sleeve 14 abuts lower end 74 of top sub 65. The downward block may be formed by upper end 76 of lower outer sleeve segment 58, which is configured to engage lower end 26 of upper inner sleeve segment 20 to limit the downward movement of inner sleeve 14 relative to outer sleeve 12. In other embodiments, hydraulic jar 10 may have other configurations including an upward block and a downward block formed of any other components of an inner sleeve and an outer sleeve that are arranged to limit the upward and downward axial movement of inner sleeve 14 relative to outer sleeve 12.

With reference to FIG. 4, inner sleeve 14 may slide axially relative to outer sleeve 12 until reaching an activated position (shown in FIG. 4). In this embodiment, lower end 26 of upper inner sleeve segment 20 engages upper end 76 of lower outer sleeve segment 58 (i.e., the downward block) in the activated position. When pulling with the drill string on top sub 65, inner sleeve 14 slides downward (in the illustrated orientation), upper cavity shoulder 32 applies a downward force on a hydraulic fluid held in upper cavity 48. This causes a portion of the hydraulic fluid to flow through a small space between the outer surface of upper inner sleeve segment 20 and throttling ring 44. In this way, the hydraulic fluid is transferred from upper cavity 48 to lower cavity 50 as inner sleeve 14 slides axially downward relative to outer sleeve 12. In the activated position shown in FIG. 4, lower cavity 50 is larger than upper cavity 48. An impact force is created when the small space between the outer surface of upper inner sleeve segment 20 and throttling ring 44 opens up and the hydraulic fluid can flow freely from upper cavity 48 to lower cavity 50 and lower end 26 of upper inner sleeve segment 20 strikes upper end 76 of lower outer sleeve segment 58 to stop the downward axial movement of inner sleeve 14. This impact force is transmitted to components connected above and below hydraulic jar 10. A user may activate hydraulic jar 10 in order to create an impact force or impact load to loosen a portion of a tubular string or bottom hole assembly that is stuck or immobilized in an area of a wellbore.

Figure 5:
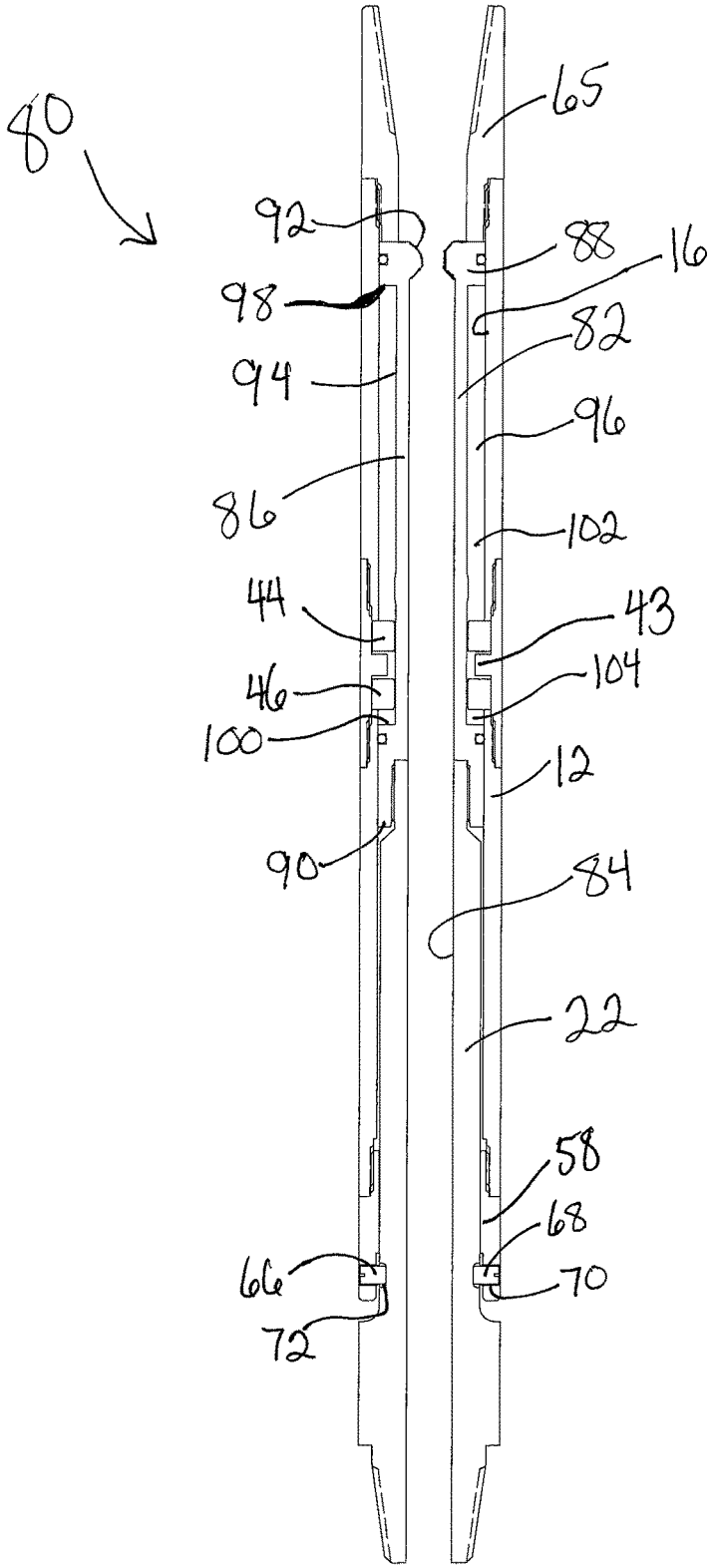
FIG. 5 is a sectional view of a second embodiment of a mechanically locking hydraulic jar in a default position.

FIG. 5 illustrates mechanically locking hydraulic jar 80. Except as otherwise described, hydraulic jar 80 includes the same components, features, and functions as hydraulic jar 10. Hydraulic jar 80 may include outer sleeve 12 and inner sleeve 82 partially disposed within inner bore 16 of outer sleeve 12. Inner sleeve 82 includes inner bore 84. Except as otherwise noted, inner sleeve 82 includes the same components, features, and functions as inner sleeve 14.

Referring still to FIG. 5, inner sleeve 82 includes upper inner sleeve segment 86 and lower inner sleeve segment 22. Upper inner sleeve segment 86 is completely disposed within inner bore 16 of outer sleeve 12, while lower inner sleeve segment 22 is partially disposed within inner bore 16 of outer sleeve 12. Upper inner sleeve segment 86 extends from upper end 88 of inner sleeve 82 to lower end 90 of upper inner sleeve segment 86. Upper end 88 may include ball seat surface 92 configured to receive a ball pumped through the inner bore of hydraulic jar 80. In the same arrangement as in upper inner sleeve segment 20, upper inner sleeve segment 86 may include recess 94 forming cavity 96 between outer sleeve 12 and inner sleeve 82. Cavity 96 may extend from upper cavity shoulder 98 to lower cavity shoulder 100 of the outer surface of upper inner sleeve segment 86. Upper and lower inner sleeve segments 86, 22 may be secured together by threaded connection.

Inward protrusion 43 of outer sleeve 12 is axially aligned with cavity 96. Throttling rings 44 and 46 are disposed in cavity 96, with throttling ring 44 above inward protrusion 43 and throttling ring 46 below inward protrusion 43. Upper cavity 102 is formed between upper cavity shoulder 98 and throttling ring 44, and lower cavity 104 is formed between throttling ring 46 and lower cavity shoulder 100. A hydraulic fluid may be disposed within cavity 96.

Hydraulic jar 80 may also include top sub 65 connected above outer sleeve 12. Top sub 65 is configured to attach hydraulic jar 80 below a tubular string or a coiled tubing string. Hydraulic jar 80 further includes a mechanical lock as described above in connection with hydraulic jar 10. In the illustrated embodiment, the mechanical lock includes shear pins 66, 68 each partially disposed in one of the radial bores 70 in lower outer sleeve segment 58 and partially disposed in one of the recesses 72 in lower inner sleeve segment 22 in the default position illustrated in FIG. 5. Alternatively, the mechanical lock of hydraulic jar 80 may include a snap ring, a mechanical nose, or a ball and wedge combination as described above.

Figure 6:
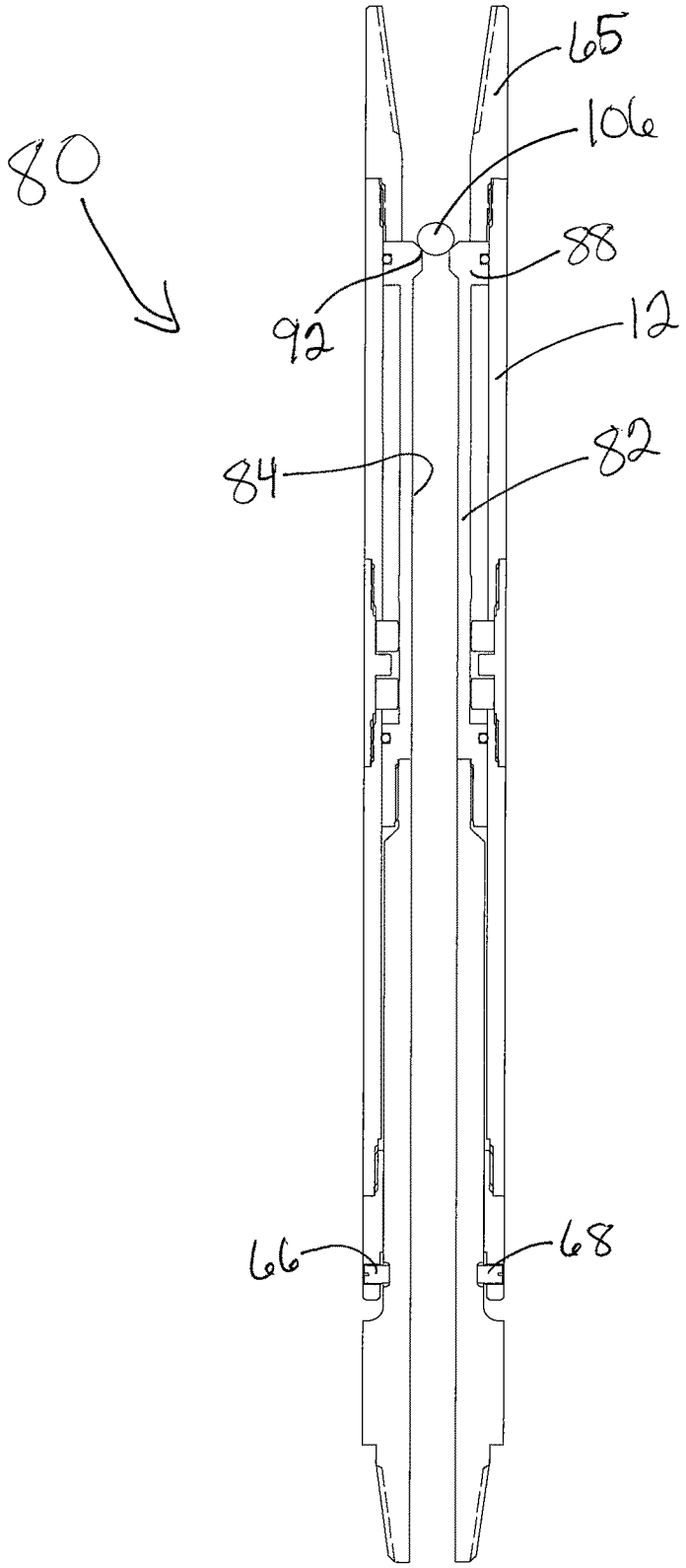
FIG. 6 is a sectional view of the hydraulic jar in FIG. 5, with a ball positioned on a ball seat of the hydraulic jar in the default position.

With reference to FIG. 6, hydraulic jar 80 may be activated by pumping ball 106 in a fluid through the tubular string or coiled tubing string above hydraulic jar 80. When ball 106 reaches hydraulic jar 80, ball 106 engages ball seat 92 on upper end 88 of inner sleeve 82. Ball 106 fluidly seals inner bore 84 of inner sleeve 82. A downward force is applied to upper end 88 of inner sleeve 82 with the continued pumping of fluid above ball 106. When the downward force exceeds a threshold, the mechanical lock is disabled to allow relative axial movement between inner sleeve 82 and outer sleeve 12, which causes hydraulic jar 80 to impart an impact load on the components attached to hydraulic jar 80. In the embodiment illustrated, the downward force on inner sleeve 82 severs shear pins 66 and 68 to disable the mechanical lock and to allow the axial movement of inner sleeve 82 relative to outer sleeve 12.

Figure 7:
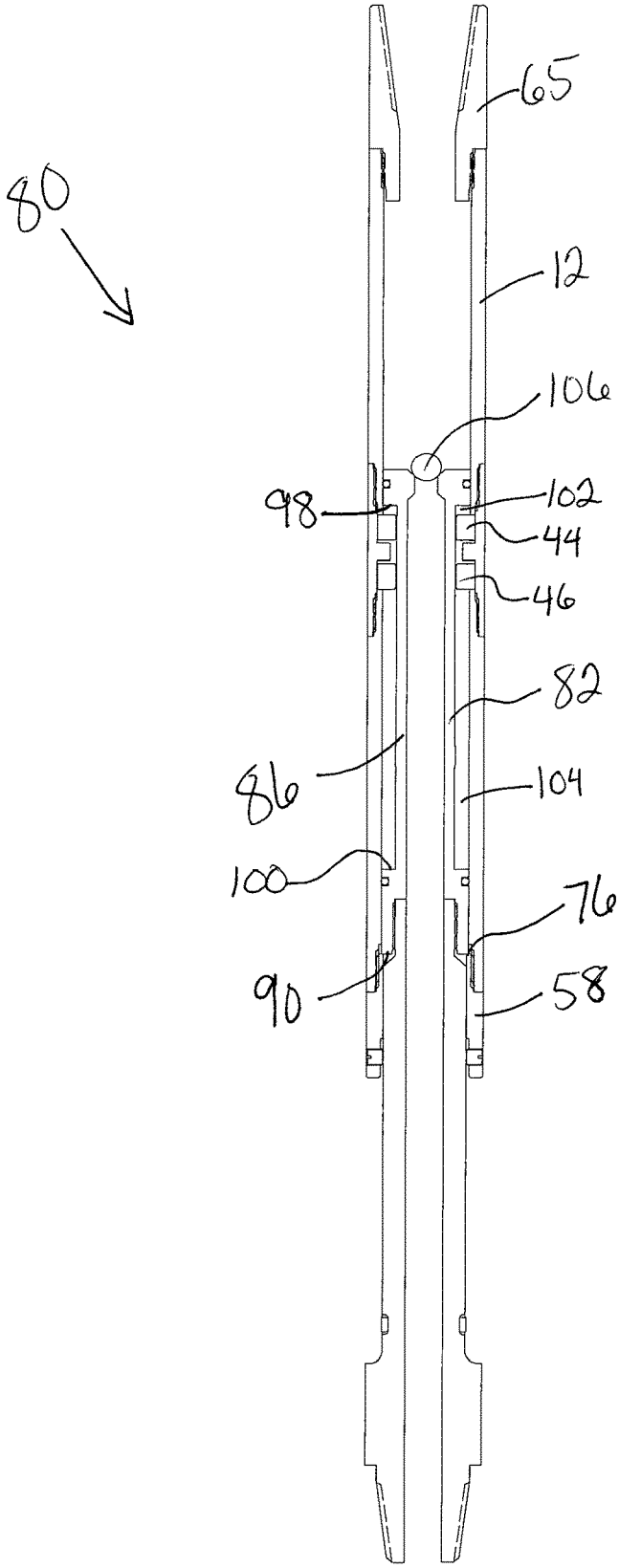
FIG. 7 is a sectional view of the hydraulic jar in FIG. 5 in an activated position.

Inner sleeve 82 may move axially downward relative to outer sleeve 12 until reaching the activated position shown in FIG. 7. The downward movement of inner sleeve 82 is limited by the interaction of lower end 90 of upper inner sleeve segment 86 with upper end 76 of lower outer sleeve segment 58 (the downward block). As inner sleeve 82 slides downward (in the illustrated orientation), upper cavity shoulder 98 applies a downward force on a hydraulic fluid held in upper cavity 102. This causes a portion of the hydraulic fluid to flow through a small space between the outer surface of inner sleeve 82 and throttling ring 44. In this way, the hydraulic fluid is transferred from upper cavity 102 to lower cavity 104 as inner sleeve 82 slides axially downward relative to outer sleeve 12. An impact force is created when the small space between the outer surface of inner sleeve 82 and first throttling ring 44 opens up and the hydraulic fluid flows from upper cavity 102 to lower cavity 104 and lower end 90 of upper inner sleeve segment 86 strikes upper end 76 of lower outer sleeve segment 58 to stop the downward axial movement of inner sleeve 82. This impact force is transmitted to components connected above and below hydraulic jar 80. A user may activate hydraulic jar 80 in order to create an impact force or impact load to loosen a portion of a tubular string or bottom hole assembly that is stuck or immobilized in an area of a wellbore.

In an alternate embodiment, the mechanically locking hydraulic jar is designed to allow the inner sleeve to slide axially upward relative to the outer sleeve when the mechanical lock is disabled. This arrangement may be accomplished by rearranging the parts in hydraulic jar 10 or hydraulic jar 80. In another alternate embodiment, the mechanically locking hydraulic jar is designed to allow the inner sleeve to slide both axially upward and axially downward relative to the outer sleeve when the mechanical lock is disabled.

Figure 8:
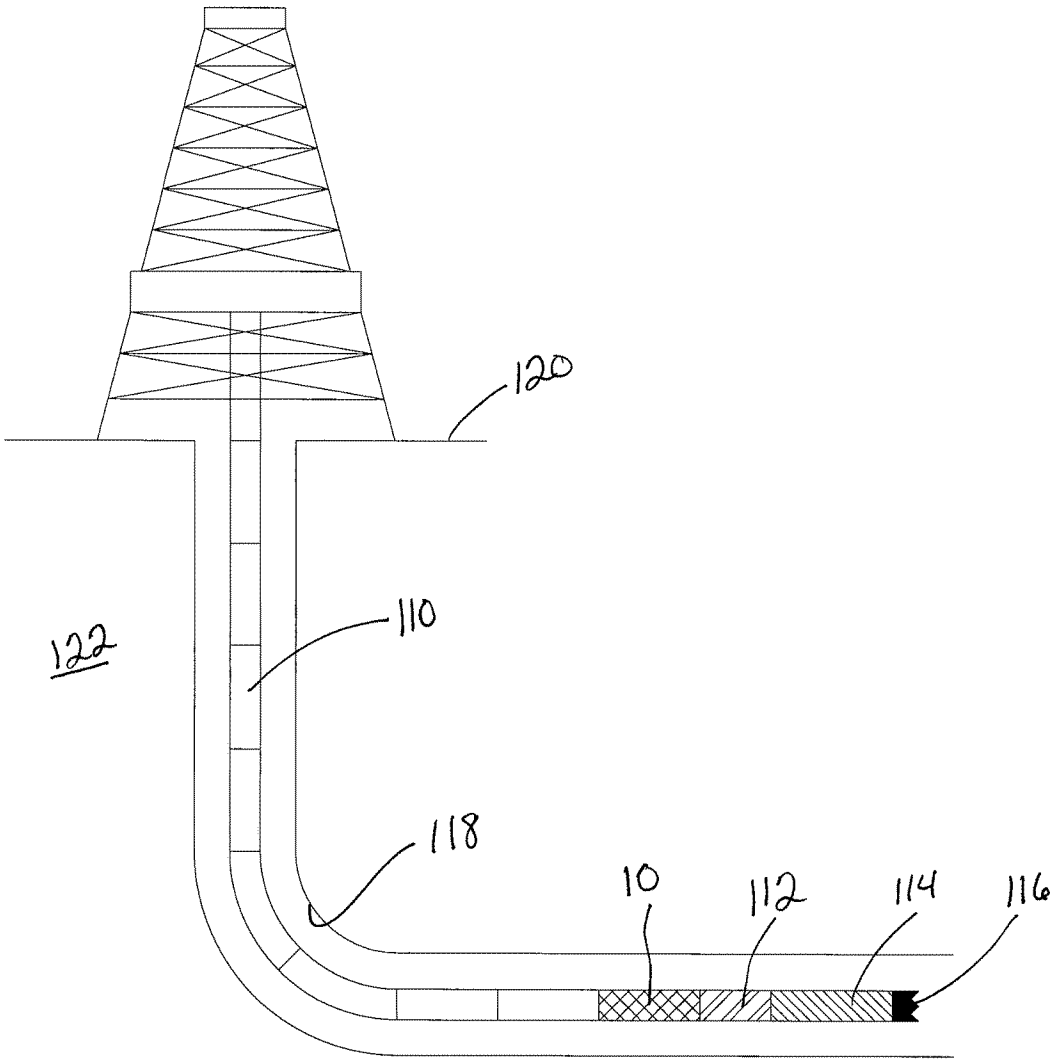
FIG. 8 is a schematic view of a mechanically locking hydraulic jar connected below a tubular string in a wellbore.

Referring now to FIG. 8, mechanically locking hydraulic jar 10 may be secured below tubular string 110. Measurement while drilling sub 112, drilling motor 114, and drill bit 116 may be secured below hydraulic jar 10. Tubular string 110, hydraulic jar 10, and the components secured below may be lowered into wellbore 118 extending below surface 120 through subterranean formation 122. If drill bit 116 or any other component or portion of tubular string 110 becomes immobilized or "stuck" in wellbore 118, a user may activate hydraulic jar 10 as described above to generate an impact force that is transmitted throughout tubular string 110. The mechanical lock of hydraulic jar 10 prevents unintentional activation of hydraulic jar 10 by any tool incorporated into tubular string 110, such as those that create a pressure pulse or vibration. As described above, hydraulic jar 10 may be activated by applying a downward force on inner sleeve 14 through tubular string 110 or by applying an upward force on outer sleeve 12 through tubular string 110. Hydraulic jar 80 may be secured to tubular string 110 as shown in FIG. 8 in the same manner described for hydraulic jar 10, and may be used for the same purposes as hydraulic jar 10. As described above, hydraulic jar 80 may be activated by pumping a fluid with ball 106 through tubular string 110 until ball 106 engages ball seat 92 of inner sleeve 82.

Figure 9:
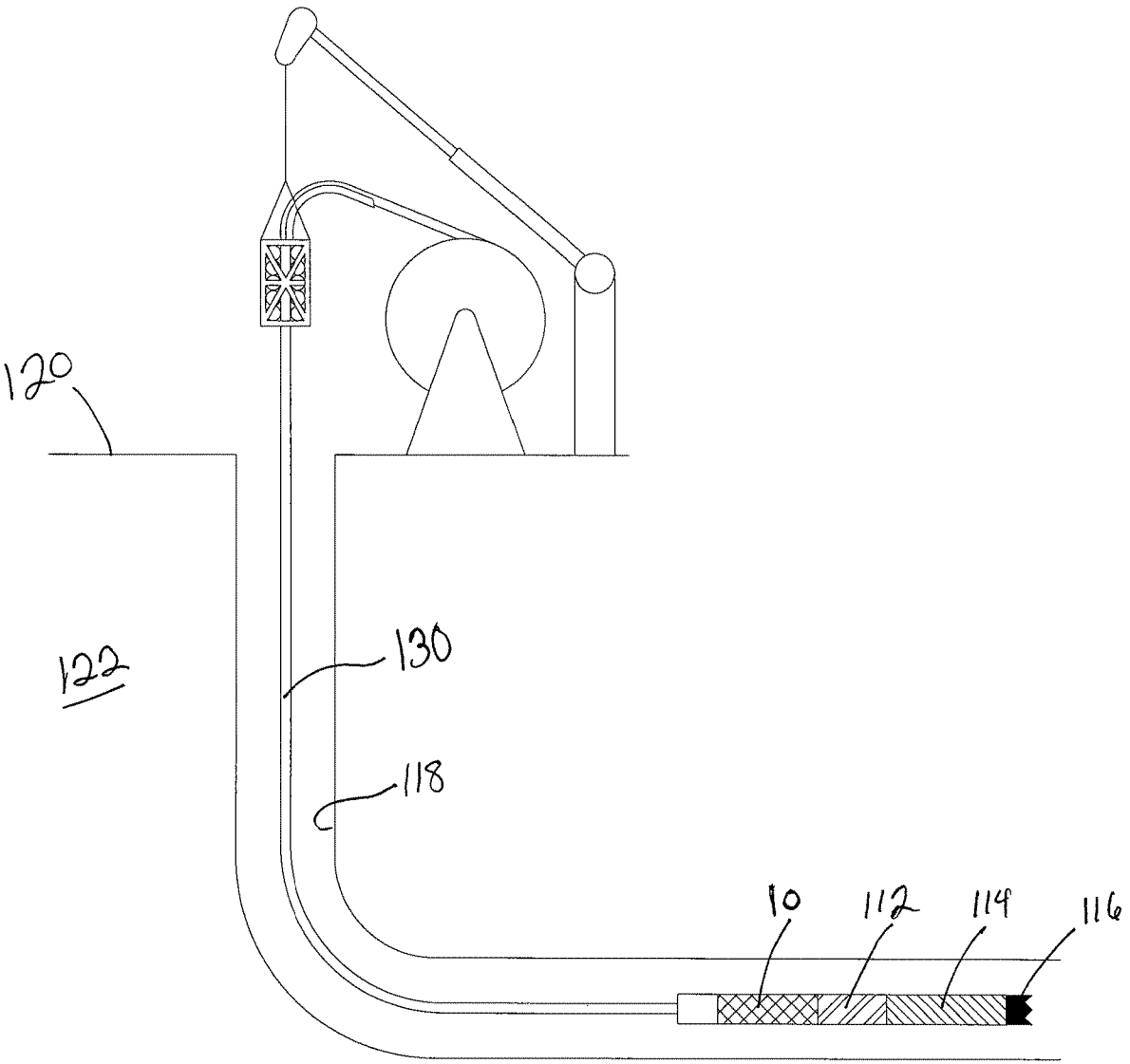
FIG. 9 is a schematic view of a mechanically locking hydraulic jar connected below a coiled tubing string in a wellbore.

With reference to FIG. 9, mechanically locking hydraulic jar 10 may be secured below coiled tubing string 130, with measurement while drilling sub 112, drilling motor 114, and drill bit 116 secured below hydraulic jar 10. Coiled tubing string 130, hydraulic jar 10, and the components secured below may be lowered into wellbore 118 extending below surface 120 through subterranean formation 122. If drill bit 116 or any other component becomes immobilized or "stuck" in wellbore 118, a user may activate hydraulic jar 10 as described above to generate an impact force that is transmitted throughout coiled tubing 130. The mechanical lock of hydraulic jar 10 prevents unintentional activation of hydraulic jar 10 by any tool incorporated into the bottom hole assembly that creates a pressure pulse or vibration. As described above, hydraulic jar 10 may be activated by applying an upward force on outer sleeve 12 through coiled tubing string 130. Hydraulic jar 80 may be secured to coiled tubing string 130 as shown in FIG. 9 in the same manner described for hydraulic jar 10, and may be used for the same purposes as hydraulic jar 10. As described above, hydraulic jar 80 may be activated by pumping a fluid with ball 106 through coiled tubing string 130 until ball 106 engages ball seat 92 of inner sleeve 82.

The mechanical lock may include any components configured to engage the outer and inner sleeves in the default position, and configured to be sheared, retracted, or otherwise disabled to allow axial movement of the inner sleeve relative to the outer sleeve to place the hydraulic jar in the activated position. For example, the mechanical lock may include one or more shear members (e.g., set screws, shear pins, shear pin balls, dowels), spring-loaded dogs, or protrusions. In other examples, the mechanical lock may include a snap ring, a collet arrangement, or a ball and wedge combination.

Figure 10:
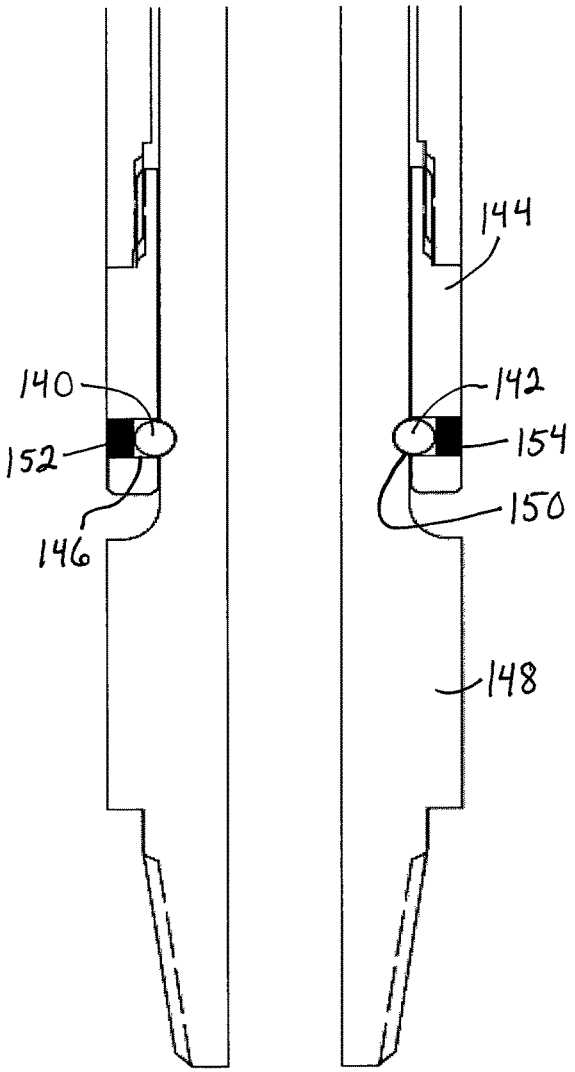
FIG. 10 is a partial sectional view showing the default position of the hydraulic jar with an alternate mechanical lock.
Figure 11:
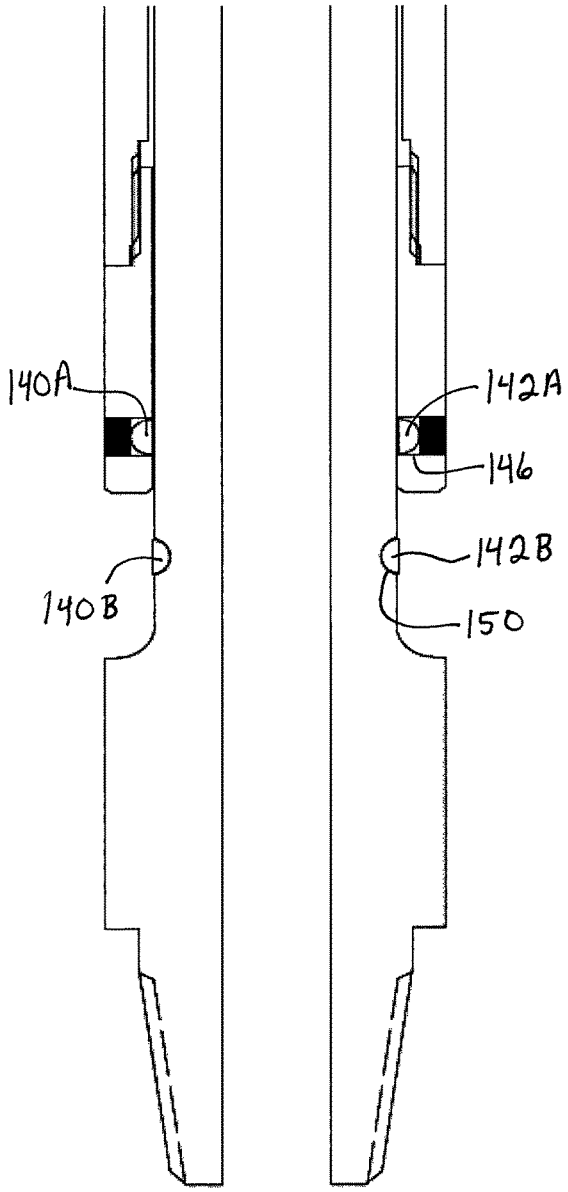
FIG. 11 is a partial sectional view showing the activated position of the hydraulic jar with the mechanical lock shown in FIG. 10.

In the embodiment shown in FIGS. 10-11, the mechanical lock of the hydraulic jar includes shear pin balls 140, 142. The mechanical lock may include any number of shear pin balls, such as 1-10 shear pin balls. Lower outer sleeve segment 144 includes one or more radial bores 146. The outer surface of lower inner sleeve segment 148 includes one or more recesses 150. In the default position shown in FIG. 10, each recess 150 is aligned with one of the radial bores 146 and each of the shear pin balls 140, 142 is partially disposed within a radial bore 146 and a recess 150 in lower inner sleeve segment 148. Shear pin balls 140, 142 may be retained within radial bores 146 with plugs or set screws 152, 154. In this way, shear pin balls 140, 142 engage the inner sleeve and the outer sleeve in the default position to prevent relative axial movement between the inner and outer sleeves. With reference to FIG. 11, activation of the hydraulic jar may cause shear pin balls 140, 142 to be severed into segments 140A, 142A held in radial bores 146 of lower outer sleeve segment 144 and segments 140B, 142B held, at least initially, in recesses 150 of lower inner sleeve segment 148, respectively. The severing of shear pin balls 140, 142 disables the mechanical lock to allow the inner sleeve of the hydraulic jar to move axially relative to the outer sleeve.

Figure 12:
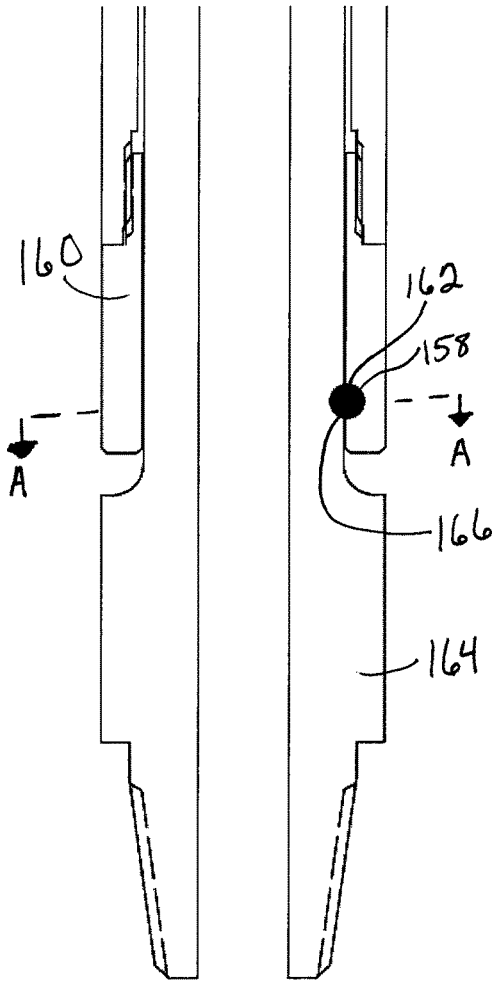
FIG. 12 is a partial sectional view showing the default position of the hydraulic jar with a second alternate mechanical lock.
Figure 13:
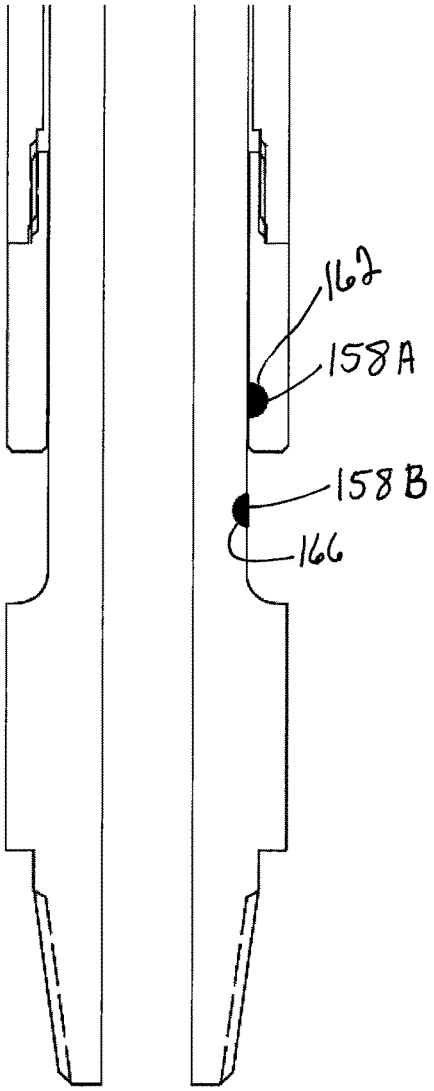
FIG. 13 is a partial sectional view showing the activated position of the hydraulic jar with the mechanical lock shown in FIG. 12.
Figure 14:
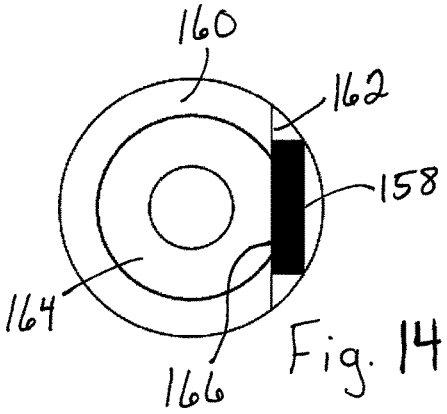
FIG. 14 is a cross-sectional view taken from line A-A in FIG. 12.

In the embodiment shown in FIGS. 12-14, the mechanical lock of the hydraulic jar includes dowel 158. The mechanical lock may include any number of dowels, such as 1-4 dowels. Lower outer sleeve segment 160 includes one or more bores 162. The outer surface of lower inner sleeve segment 164 includes one or more recesses 166. In the default position shown in FIG. 12, recess 166 is aligned with bore 162 and dowel 158 is partially disposed within bore 162 and recess 166 in lower inner sleeve segment 164. In this way, dowel 158 engages the inner sleeve and the outer sleeve in the default position to prevent relative axial movement between the inner and outer sleeves. With reference to FIG. 13, activation of the hydraulic jar may cause dowel 158 to be severed into segments 158A held in bore 162 of lower outer sleeve segment 160 and segment 158B held, at least initially, in recess 166 of lower inner sleeve segment 164, respectively. The severing of dowel 158 disables the mechanical lock to allow the inner sleeve to move axially relative to the outer sleeve.

Figure 15:
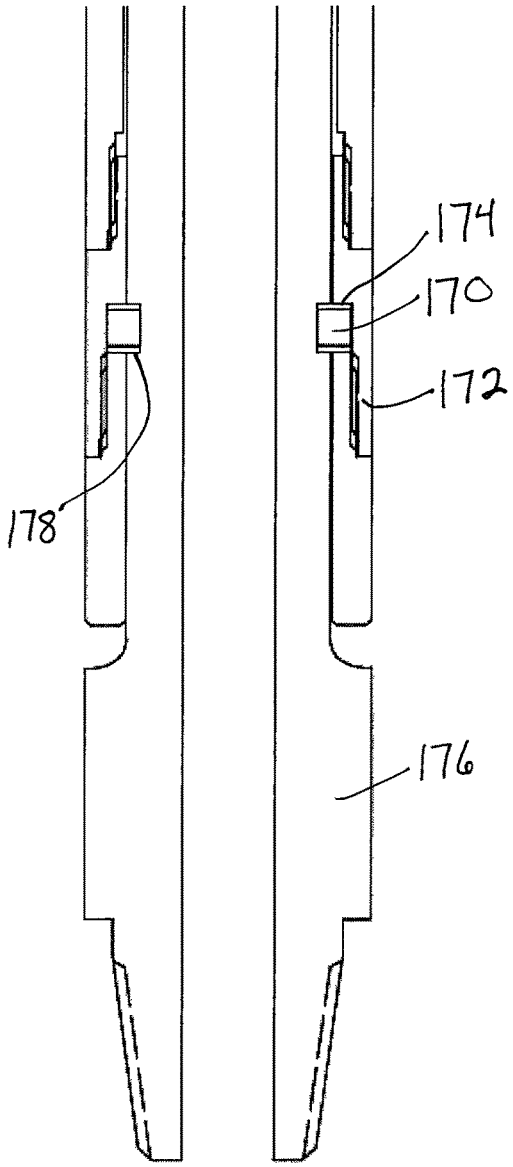
FIG. 15 is a partial sectional view showing the default position of the hydraulic jar with a third alternate mechanical lock.
Figure 16:
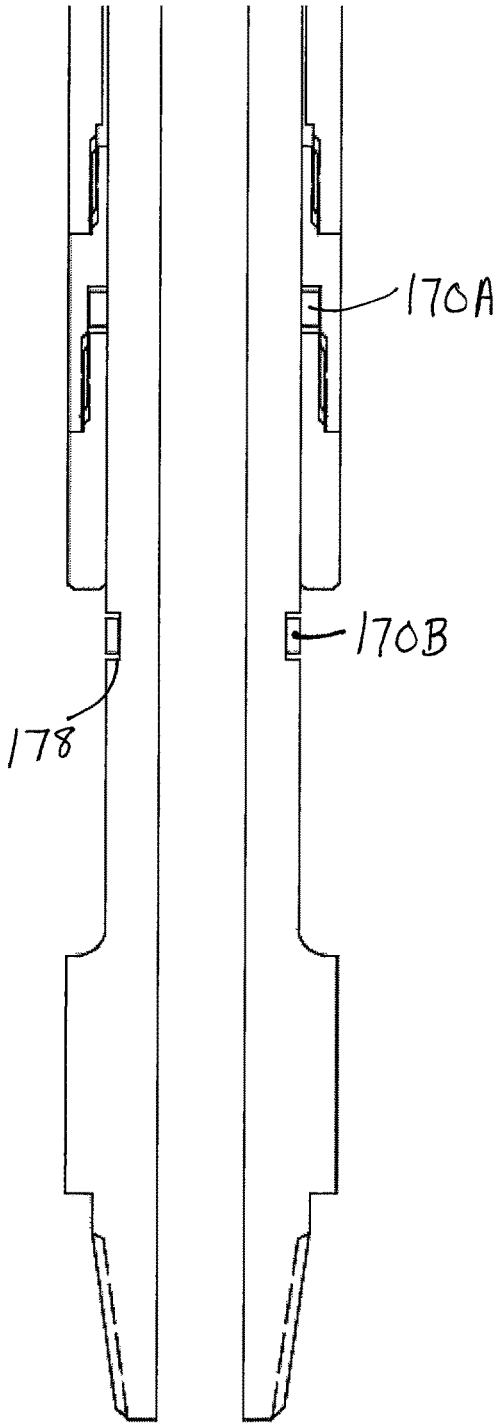
FIG. 16 is a partial sectional view showing the activated position of the hydraulic jar with the mechanical lock shown in FIG. 15.

In the embodiment shown in FIGS. 15-16, the mechanical lock of the hydraulic jar includes snap ring 170. Lower outer sleeve segment 172 includes recess 174. Recess 174 may be formed by a shoulder on the inner surface of lower outer sleeve segment 172. The outer surface of lower inner sleeve segment 176 includes recess 178. In the default position shown in FIG. 15, recess 174 is aligned with recess 178 and snap ring 170 is partially disposed within recess 174 and recess 178 in lower inner sleeve segment 176. In this way, snap ring 170 engages the inner sleeve and the outer sleeve in the default position to prevent relative axial movement between the inner and outer sleeves. With reference to FIG. 16, activation of the hydraulic jar may cause snap ring 170 to be severed or broken into segments 170A held in recess 174 of lower outer sleeve segment 172 and segment 170B held, at least initially, in recess 178 of lower inner sleeve segment 176, respectively. The severing of snap ring 170 disables the mechanical lock to allow the inner sleeve to move axially relative to the outer sleeve.

Figure 17:
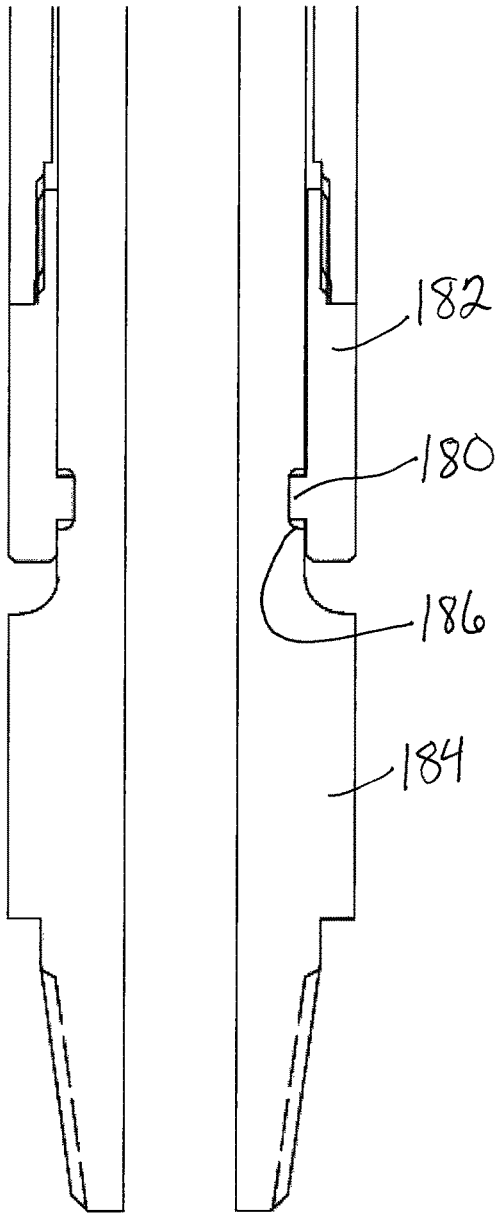
FIG. 17 is a partial sectional view showing the default position of the hydraulic jar with a fourth alternate mechanical lock.
Figure 18:
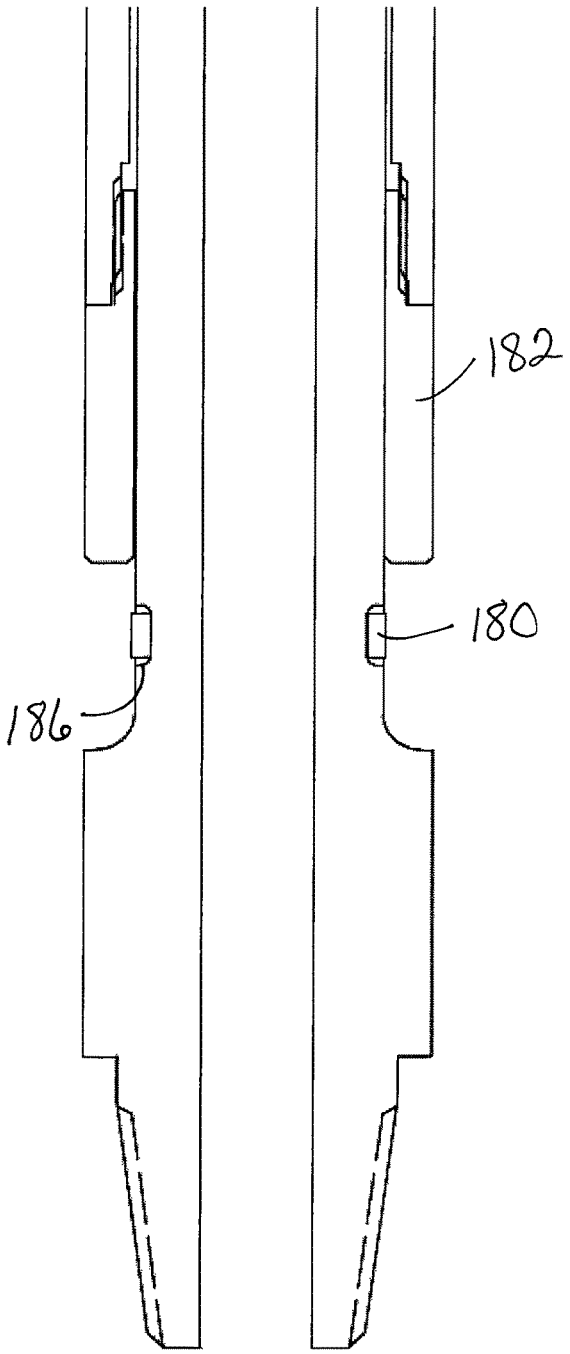
FIG. 18 is a partial sectional view showing the activated position of the hydraulic jar with the mechanical lock shown in FIG. 17.

In the embodiment shown in FIGS. 17-18, the mechanical lock of the hydraulic jar includes protrusion 180 extending radially inward from an inner surface of lower outer sleeve segment 182. The hydraulic jar may include a single protrusion or numerous protrusions around the circumference of the inner surface of lower outer sleeve segment 182. The outer surface of lower inner sleeve segment 184 includes recess 186. In the default position shown in FIG. 17, protrusion 180 is at least partially disposed within recess 186 in lower inner sleeve segment 184. In this way, protrusion 180 of the outer sleeve engages the inner sleeve in the default position to prevent relative axial movement between the inner and outer sleeves. With reference to FIG. 18, activation of the hydraulic jar may cause protrusion 180 to be severed from lower outer sleeve segment 182. The severing of protrusion 180 disables the mechanical lock to allow the inner sleeve to move axially relative to the outer sleeve.

Figure 19:
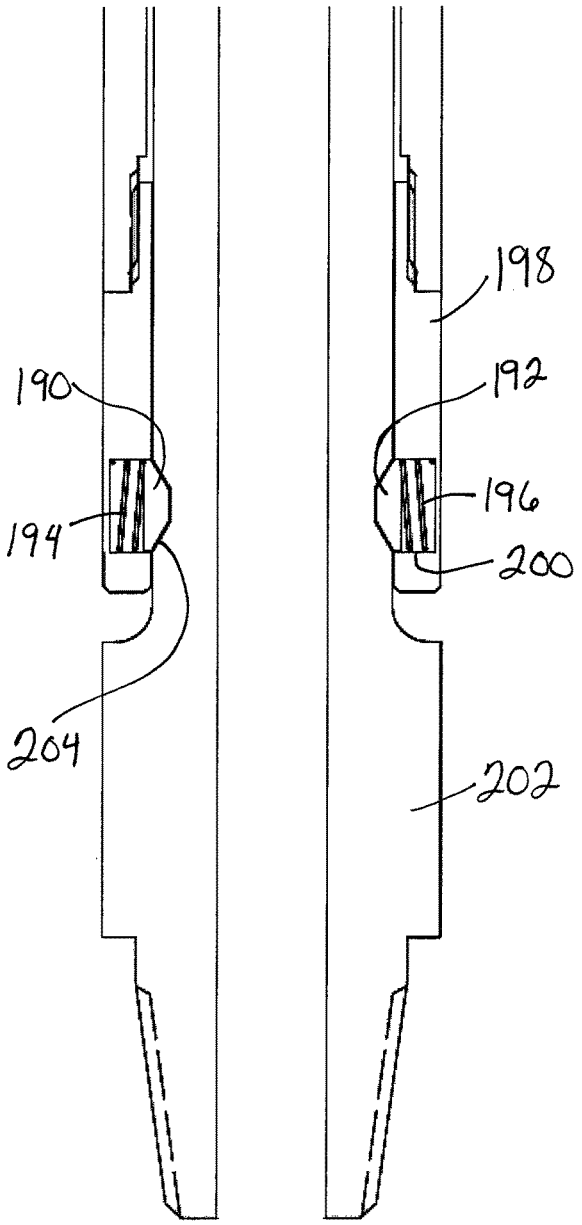
FIG. 19 is a partial sectional view showing the default position of the hydraulic jar with a fifth alternate mechanical lock.
Figure 20:
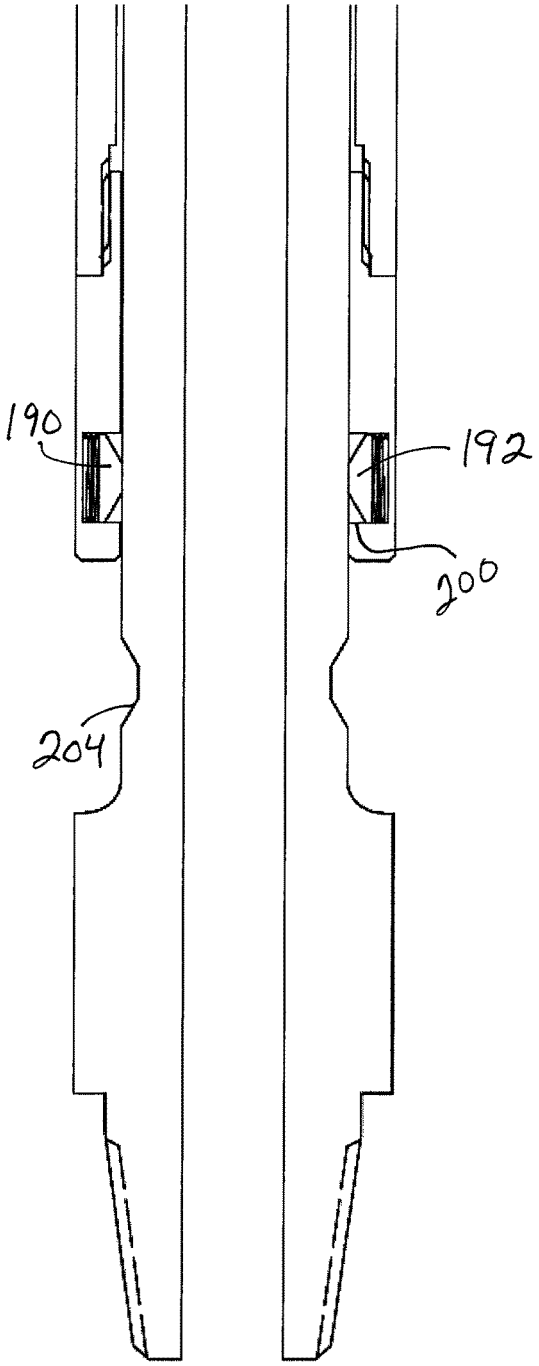
FIG. 20 is a partial sectional view showing the activated position of the hydraulic jar with the mechanical lock shown in FIG. 19.

In the embodiment shown in FIGS. 19-20, the mechanical lock of the hydraulic jar includes dogs 190, 192 biased by springs 194, 196, respectively, in a radially inward direction. The mechanical lock may include any number of dogs biased by springs, such as 1-10 dogs. Lower outer sleeve segment 198 includes one or more radial bores 200. The outer surface of lower inner sleeve segment 202 includes recess 204. Springs 194, 196 are each disposed within one of the radial bores 200 in lower outer sleeve segment 198. In the default position shown in FIG. 19, recess 204 is aligned with bores 200 and each dog 190, 192 is partially disposed within one of the radial bores 200 and partially disposed within recess 204 in lower inner sleeve segment 202. In this way, dogs 190, 192 engage the inner sleeve and the outer sleeve in the default position to prevent relative axial movement between the inner and outer sleeves. With reference to FIG. 20, activation of the hydraulic jar may overcome the spring force of springs 194, 196 to push dogs 190, 192 outward into radial bores 200. Recess 204 in lower inner sleeve segment 202 may include an upper tapered surface and a lower tapered surface, which may be configured to allow for retraction of dogs 190, 192 without severing these components. The retraction of dogs 190, 192 disables the mechanical lock to allow the inner sleeve to move axially relative to the outer sleeve.

Figure 21:
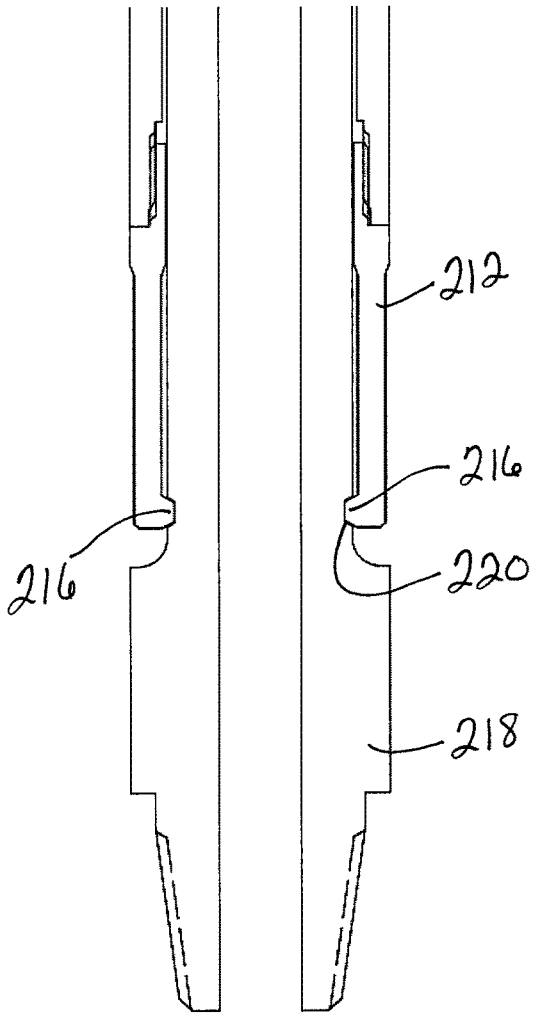
FIG. 21 is a partial sectional view showing the default position of the hydraulic jar with a sixth alternate mechanical lock.
Figure 22:
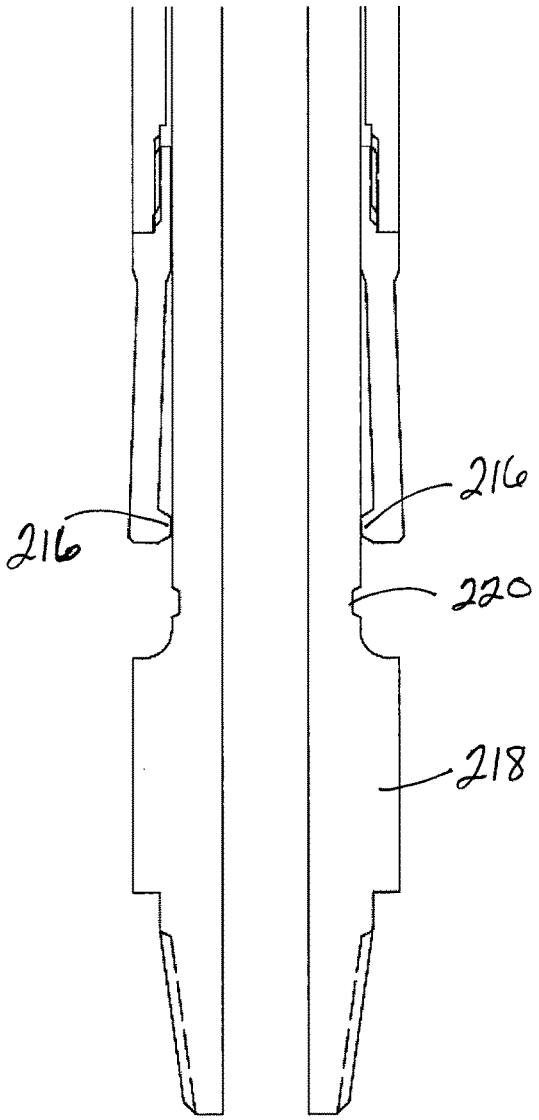
FIG. 22 is a partial sectional view showing the activated position of the hydraulic jar with the mechanical lock shown in FIG. 21.
Figure 23:
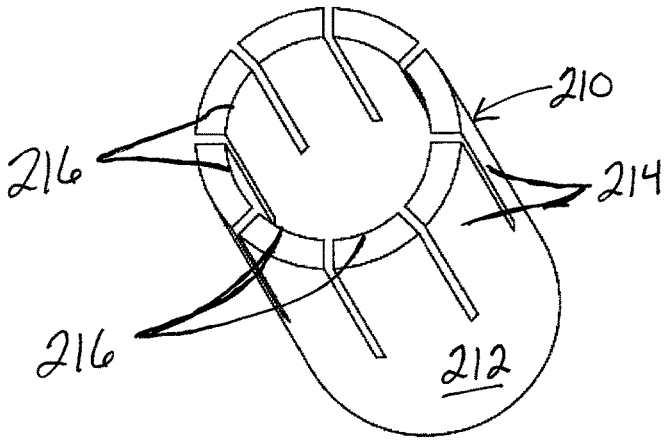
FIG. 23 is a perspective view of a lower outer sleeve segment in the embodiment illustrated in FIG. 21.

In the embodiment shown in FIGS. 21-23, the mechanical lock of the hydraulic jar includes collet assembly 210 on lower outer sleeve segment 212. As shown in FIG. 23, collet assembly 210 may include two or more segments 214. A lower end of each segment 214 includes inward protrusion 216. The outer surface of lower inner sleeve segment 218 includes recess 220. In the default position shown in FIG. 21, protrusions 216 are at least partially disposed within recess 220 in lower inner sleeve segment 218. In this way, protrusions 216 of the outer sleeve engage the inner sleeve in the default position to prevent relative axial movement between the inner and outer sleeves. With reference to FIG. 22, activation of the hydraulic jar may force protrusions 216 radially outward (i.e., expanded radially), thereby disabling the mechanical lock and allowing the inner sleeve of the hydraulic jar to move axially relative to the outer sleeve.

Except as otherwise described or illustrated, each of the components in this device has a generally cylindrical shape and may be formed of steel, another metal, or any other durable material. Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. Plurality means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A hydraulic jar device comprising:

an outer sleeve including an inner bore;

an inner sleeve partially disposed within the inner bore of the outer sleeve, wherein the inner sleeve includes an inner bore;

a mechanical lock engaging the outer sleeve and the inner sleeve in a default position to prevent axial movement of the inner sleeve relative to the outer sleeve, wherein disabling the mechanical lock allows axial movement between the inner sleeve and the outer sleeve to generate an impact force when the inner sleeve reaches an activated position;

an upward block configured to limit the upward axial movement of the inner sleeve relative to the outer sleeve when the mechanical lock is disabled;

a downward block configured to limit the downward axial movement of the inner sleeve relative to the outer sleeve when the mechanical lock is disabled; and a top sub connected above an upper end of the outer sleeve, wherein the top sub is configured to be attached below a tubular string or a coiled tubing string;

wherein the upward block is formed by a lower end of the top sub disposed within the inner bore of the outer sleeve and configured to engage an upper end of the inner sleeve, wherein the upward axial movement of the inner sleeve relative to the outer sleeve is limited by the upper end of the inner sleeve contacting the lower end of the top sub.

2. The hydraulic jar device of claim 1, wherein an upper end of the inner sleeve includes a ball seat configured to engage a ball traveling through an inner bore of the top sub to fluidly seal the inner bore of the inner sleeve and to disable the mechanical lock for allowing axial movement between the inner sleeve and the outer sleeve from the default position to the activated position.

3. The hydraulic jar device of claim 1, wherein the inner sleeve includes:

an upper inner sleeve segment completely disposed within the inner bore of the outer sleeve, wherein the upper inner sleeve segment extends from an upper end of the inner sleeve to a lower end of the upper inner sleeve segment, wherein an outer surface of the upper inner sleeve segment includes a recess forming a cavity between the outer sleeve and the upper inner sleeve segment, wherein the cavity extends from an upper cavity shoulder to a lower cavity shoulder of the outer surface of the upper inner sleeve segment;

a lower inner sleeve segment partially disposed within the inner bore of the outer sleeve, wherein the lower inner sleeve segment extends from an upper end secured to the upper inner sleeve segment to a lower end of the inner sleeve.

4. The hydraulic jar device of claim 3, wherein the inner bore of the outer sleeve includes an inward protrusion aligned with the cavity of the upper inner sleeve segment, wherein the inward protrusion is formed by a reduced diameter section of an inner surface of the inner bore of the outer sleeve.

5. The hydraulic jar device of claim 4, further comprising a first throttling ring disposed above the inward protrusion and a second throttling ring disposed below the inward protrusion, wherein the first throttling ring and the second throttling ring are disposed between the outer sleeve and the inner sleeve in the cavity of the upper inner sleeve segment.

6. The hydraulic jar device of claim 5, wherein an upper cavity is defined by the upper cavity shoulder and the first throttling ring, wherein a lower cavity is defined by the second throttling ring and the lower cavity shoulder, wherein in the default position the upper cavity is larger than the lower cavity, and wherein in the activated position the lower cavity is larger than the upper cavity.

7. The hydraulic jar device of claim 6, wherein a hydraulic fluid is disposed within the cavity, and wherein the hydraulic fluid flows from the upper cavity to the lower cavity as inner sleeve moves axially relative to outer sleeve to generate an impact force.

8. The hydraulic jar device of claim 5, wherein the outer sleeve includes:

a first outer sleeve segment;

an anchor outer sleeve segment disposed below the first outer sleeve segment, wherein the anchor outer sleeve segment includes the inward protrusion, and wherein the first throttling ring is secured between a lower end of the first outer sleeve segment and the inward protrusion;

a second outer sleeve segment disposed below the anchor outer sleeve segment, wherein the second throttling ring is secured between the inward protrusion and an upper end of the second outer sleeve segment;

a lower outer sleeve segment disposed below the second outer sleeve segment, wherein the inner bore of the lower outer sleeve segment has a reduced diameter relative to the inner bore of the first and second outer sleeve segments.

9. The hydraulic jar device of claim 8, wherein an upper end of the lower outer sleeve segment forms the downward block by engaging the lower end of the upper inner sleeve segment to limit the downward axial movement of the inner sleeve relative to the outer sleeve when the mechanical lock is disabled.

10. The hydraulic jar device of claim 1, wherein the mechanical lock includes one or more shear members each engaging the outer sleeve and the inner sleeve in the default position, and wherein the one or more shear members are configured to be severed to disable the mechanical lock to allow axial movement between the inner sleeve and the outer sleeve.

11. The hydraulic jar device of claim 10, wherein the outer sleeve includes one or more bores or recesses, wherein an outer surface of the inner sleeve includes one or more recesses, wherein in the default position each of the one or more recesses of the inner sleeve is in alignment with one of the bores or recesses of the outer sleeve and each of the one or more shear members is partially disposed within one of the bores or recesses in the outer sleeve and partially disposed within one of the recesses in the inner sleeve.

12. The hydraulic jar device of claim 11, wherein the shear members include one or more shear pins, shear pin balls, set screws, or dowels.

13. The hydraulic jar device of claim 1, wherein the mechanical lock includes a snap ring engaging the outer sleeve and the inner sleeve in the default position, and wherein the snap ring is configured to be broken to disable the mechanical lock to allow axial movement between the inner sleeve and the outer sleeve.

14. The hydraulic jar device of claim 1, wherein the mechanical lock includes an inward protrusion on an inner surface of the outer sleeve, wherein the inward protrusion engages a recess in an outer surface of the inner sleeve in the default position, and wherein a portion of the inward protrusion is configured to be sheared to disable the mechanical lock to allow axial movement between the inner sleeve and the outer sleeve.

15. The hydraulic jar device of claim 1, wherein the mechanical lock includes one or more spring-loaded dogs each engaging the outer sleeve and the inner sleeve in the default position, and wherein the one or more spring-loaded dogs are configured to be retracted to disable the mechanical lock to allow axial movement between the inner sleeve and the outer sleeve.

16. The hydraulic jar device of claim 1, wherein the mechanical lock includes a collet configuration of the outer sleeve with an inward protrusion on an inner surface of the outer sleeve, wherein the inward protrusion engages a recess in an outer surface of the inner sleeve in the default position, and wherein the inward protrusion is configured to be expanded radially to disable the mechanical lock to allow axial movement between the inner sleeve and the outer sleeve.

17. A method of providing an impact force in a wellbore, comprising the steps of:

a) providing a hydraulic jar device comprising: an outer sleeve including an inner bore; an inner sleeve partially disposed within the inner bore of the outer sleeve, wherein the inner sleeve includes an inner bore; a mechanical lock engaging the outer sleeve and the inner sleeve in a default position to prevent axial movement of the inner sleeve relative to the outer sleeve, wherein disabling the mechanical lock allows axial movement between the inner sleeve and the outer sleeve to generate an impact force when the inner sleeve reaches an activated position; an upward block configured to limit the upward axial movement of the inner sleeve relative to the outer sleeve when the mechanical lock is disabled; a downward block configured to limit the downward axial movement of the inner sleeve relative to the outer sleeve when the mechanical lock is disabled; a top sub connected above an upper end of the outer sleeve, wherein the top sub is configured to be attached below a tubular string or a coiled tubing string; wherein the upward block is formed by a lower end of the top sub disposed within the inner bore of the outer sleeve and configured to engage an upper end of the inner sleeve, wherein the upward axial movement of the inner sleeve relative to the outer sleeve is limited by the upper end of the inner sleeve contacting the lower end of the top sub;

b) securing the hydraulic jar device to a tubular string or a coiled tubing string; and securing one or more of a measurement while drilling sub, a drilling motor, and a drill bit below the hydraulic jar device;

c) running the hydraulic jar device into the wellbore with the tubular string or the coiled tubing, wherein the hydraulic jar device is in the default position;

d) when one of the components connected to the hydraulic jar device becomes immobilized within the wellbore, activating the hydraulic jar device to disable the mechanical lock, thereby allowing axial movement between the inner sleeve and the outer sleeve to an activated position creating an impact force that is transmitted to one or more components connected to the hydraulic jar device.

18. The method of claim 17, wherein in step (d) the hydraulic jar device is activated by applying an upward force on the tubular string or the coiled tubing string above the hydraulic jar device to apply an upward force on the outer sleeve of the hydraulic jar device; wherein the upward force on the outer sleeve disables the mechanical lock.

19. The method of claim 17, wherein in step (b) the top sub is secured to a tubular string; wherein in step (d) the hydraulic jar device is activated by applying a downward force on the inner sleeve of the hydraulic jar device; wherein the downward force on the inner sleeve disables the mechanical lock.

20. The method of claim 17, wherein in step (a) an upper end of the inner sleeve of the hydraulic jar device includes a ball seat; and wherein in step (d) the hydraulic jar device is activated by pumping a ball in a fluid through an inner bore of the tubular string or coiled tubing string until the ball engages the ball seat to fluidly seal the inner bore of the inner sleeve of the hydraulic jar device such that a fluid flow in the inner bore of the tubular string or the coiled tubing string applies a downward force on the inner sleeve; wherein the downward force on the inner sleeve disables the mechanical lock.

* * * * *